US011480318B1

(12) United States Patent
Xu et al.

(10) Patent No.: US 11,480,318 B1
(45) Date of Patent: Oct. 25, 2022

(54) LIGHTING LAMP

(71) Applicant: SHENZHEN SNC OPTO ELECTRONIC CO., LTD, Shenzhen (CN)

(72) Inventors: Jianjun Xu, Shenzhen (CN); Anle Zhao, Shenzhen (CN); Xingrao Wu, Shenzhen (CN); Shiyu Fu, Shenzhen (CN)

(73) Assignee: SHENZHEN SNC OPTO ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 17/691,067

(22) Filed: Mar. 9, 2022

(30) Foreign Application Priority Data

Jan. 17, 2022 (CN) ..... 202210046577.0

(51) Int. Cl.
*F21V 14/02* (2006.01)
*F21V 19/02* (2006.01)
*F21V 21/30* (2006.01)
*F21S 9/02* (2006.01)

(52) U.S. Cl.
CPC ..... *F21V 14/02* (2013.01); *F21V 19/02* (2013.01); *F21S 9/02* (2013.01); *F21V 21/30* (2013.01)

(58) Field of Classification Search
CPC ..... F21V 14/025; F21V 14/02; F21V 19/02; F21V 21/145; F21V 21/30; F21V 21/116; F21V 21/088; F21V 21/0885; F21V 23/001; F21L 4/02; F21L 4/04; F21S 9/02
See application file for complete search history.

(56) References Cited

U.S. PATENT DOCUMENTS 5,243,505 A * 9/1993 Carr ..... F21L 14/02 362/396
5,758,949 A * 6/1998 Van Deursen ..... F21V 17/007 362/186
5,775,652 A * 7/1998 Crawshaw ..... F21V 21/088 33/783
6,264,350 B1 * 7/2001 Swanson ..... F21S 6/008 362/410
7,431,483 B1 * 10/2008 Lee ..... F21V 21/40 362/423
7,810,968 B1 * 10/2010 Walker ..... F21V 21/30 362/249.02
10,429,013 B1 * 10/2019 Fang ..... F21V 21/145
2005/0111223 A1 * 5/2005 Lee ..... F21L 14/00 362/269
2009/0116210 A1 * 5/2009 Cutler ..... G08B 15/00 362/8

(Continued)

*Primary Examiner* — Jong-Suk (James) Lee
*Assistant Examiner* — James M Endo

(57) ABSTRACT

The present disclosure a light lamp including an upper body, a lower body arranged opposite to the upper body, and a lighting unit configured to light the lighting lamp. The lighting unit includes at least one first lighting module rotationally connected between the upper body and the lower body and configured to adjust an irradiation angle when the at least one first lighting module rotates. The present disclosure provides the at least one first lighting module that can adjust the irradiation angle so that the irradiation angle and an irradiation range of the lighting lamp can be adjusted, which solves a technical problem that the irradiation angle of a conventional lighting lamp can't be adjusted.

7 Claims, 9 Drawing Sheets

(56) References Cited

U.S. PATENT DOCUMENTS

| | | | | |
|---|---|---|---|---|
| 2011/0211340 | A1* | 9/2011 | Smith | F21L 4/04 362/191 |
| 2011/0222274 | A1* | 9/2011 | Ko | F21L 4/00 362/220 |
| 2011/0254470 | A1* | 10/2011 | Penoyer | F21S 2/005 362/183 |
| 2012/0057333 | A1* | 3/2012 | Bhardwaj | F21S 9/03 362/183 |
| 2012/0140441 | A1* | 6/2012 | Chang | F21V 19/02 362/95 |
| 2012/0140473 | A1* | 6/2012 | Chang | F21V 21/30 362/249.03 |
| 2013/0271993 | A1* | 10/2013 | Jan | F21V 14/02 362/249.1 |
| 2014/0268775 | A1* | 9/2014 | Kennemer | B60Q 1/24 362/369 |
| 2018/0128435 | A1* | 5/2018 | Workman | F21V 3/02 |
| 2018/0156427 | A1* | 6/2018 | Bailey | F21V 23/001 |
| 2018/0202639 | A1* | 7/2018 | Kao | F21V 21/30 |
| 2019/0285251 | A1* | 9/2019 | Li | F21V 31/005 |
| 2019/0293246 | A1* | 9/2019 | Hou | F21V 19/001 |
| 2020/0284425 | A1* | 9/2020 | Plato | F21V 21/30 |
| 2020/0300420 | A1* | 9/2020 | Guo | F21V 23/009 |

* cited by examiner

LIGHTING LAMP

BACKGROUND

1. Technical Field

The present disclosure generally relates to the field of lighting technologies, and especially relates to a lighting lamp.

2. Description of Related Art

Conventional LED lamps generally include lighting bars, bulb lamps, spotlights and high-power mining lamps. The lighting bar, with a small power, is only suitable for decoration and other fields, which can't meet a condition with a long-distance and a large-range lighting. The bulb lamp has a relatively large lighting range and a poor heat dissipation effect, so that it is not suitable for a high-power lighting condition and can only be used a household lighting, which can't meet requirements of outdoors, warehouse or portable lighting. The spotlight has a small power and is difficult to adjust an irradiation range and an irradiation angle thereof.

The mining lamp with a high power is mainly installed in open areas, such as a warehouse and a public place by means of a fixed installation way, which are characterized by a high power and a high brightness, rather than meeting requirements of portable lighting; in addition, for different lighting environments, a lighting direction and an irradiation angle of the mining lamp also can't be adjusted, which is inconvenient to be operated. Even if there are some adjustable mining lamps, users need to adjust a lamp supporter of the mining lamp that is installed at a specific position such as a wall, which is very inconvenient.

At present, in the field of lighting, there is no lighting lamp with multi-functions and multi-scene applications that can easily adjust the irradiation angle thereof, be portable and adopt a variety of power supply modes.

SUMMARY

The technical problems to be solved: in view of the shortcomings of the related art, the present disclosure relates to a lighting lamp which can solve a technical problem that an irradiation angle of a conventional lighting lamp can't be adjusted.

a lighting lamp according to an embodiment of the present disclosure includes:

an upper body;

a lower body arranged opposite to the upper body; and a lighting unit configured to light the lighting lamp and including at least one first lighting module rotationally connected between the upper body and the lower body; and wherein the at least one first lighting module is configured to adjust an irradiation angle when the at least one first lighting module rotates.

The above lighting lamp of the present disclosure can adjust an irradiation angle of the first lighting module by rotating the first lighting module, so as to implement a lighting application of the lighting lamp in a variable range thereof.

A lighting lamp according to another embodiment of the present disclosure includes:

an upper body;

a lighting unit arranged on a bottom side of the upper body;

a rotating portion rotationally arranged on a top side of the upper body; and wherein the rotating portion rotates to adjust an irradiation angle of the lighting unit.

The lighting lamp of the present disclosure can rotate the lighting unit through the rotating portion, so as to adjust the irradiation angle and a lighting range of the lighting lamp, which can solve a technical problem that the irradiation angle of a conventional lighting lamp can't be adjusted.

Figure 1:
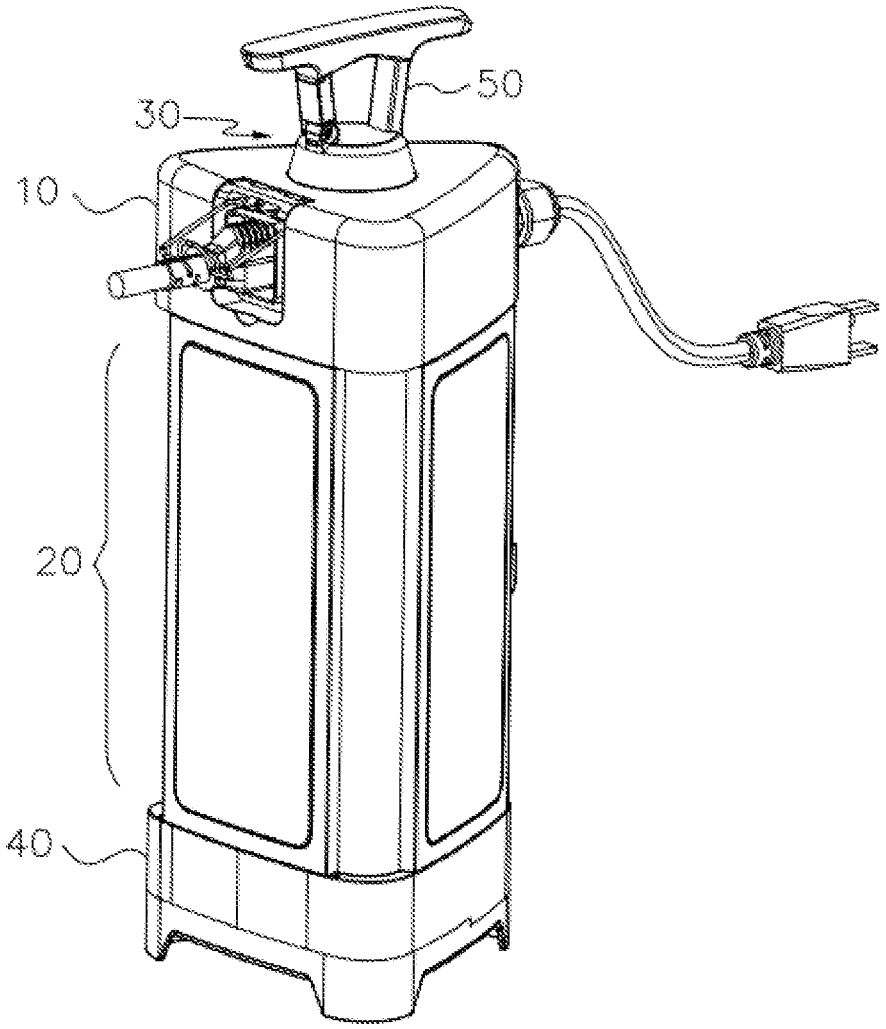
FIG. 1 is a schematic view of a lighting lamp in accordance with an embodiment of the present disclosure.

The element labels according to the embodiment of the present disclosure shown as below:

upper body 10/10", driving module 11, lighting unit 20/20', emergency power supply module 21, first lighting module 22, first rotating member 221, first rotating shaft 2211, first shaft hole 2212, first connecting member 222, second rotating shaft 2221, second shaft hole 2222, first limiting member 223, first pinball 2231, limiting hole 2232, second limiting member 224, block 2241, protrusion 2242, concave hole 2243, second lighting module 23, frame 231, lighting plate 232, lampshade 233, rotating portion 30, fixing disc 31, through-hole 311, upper cover 32, fixing post 321, third limiting member 33, receiving hole 331, second pinball 332, fixing member 34, threaded post 35, threaded hole 36, lower body 40/40', hanging ring 50.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein.

Referring to FIG. 1, a lighting lamp according to an embodiment of the present disclosure includes an upper body 10, a lighting unit 20 arranged on a bottom side of the upper body 10, and a rotating portion 30 rotationally arranged on a top side of the upper body 10 and arranged away from the lighting unit 20. The rotating portion 30 rotates to adjust an irradiation angle of the lighting unit 20.

Furthermore, the lighting lamp further includes a hanging ring 50 fixed with the rotating portion 30.

In an embodiment of the present disclosure, when the lighting lamp is fixed through the hanging ring 50, the lighting unit 20 can be rotated, and the lighting unit 20 can rotate relative to the hanging ring 50 through the rotating portion 30, so as to adjust an irradiation angle of the lighting lamp.

When the lighting unit 20 rotates, the rotating portion 30 rotates internally, so that an angle of the lighting unit 20 and the hanging ring 50 can be changed.

Figure 2:
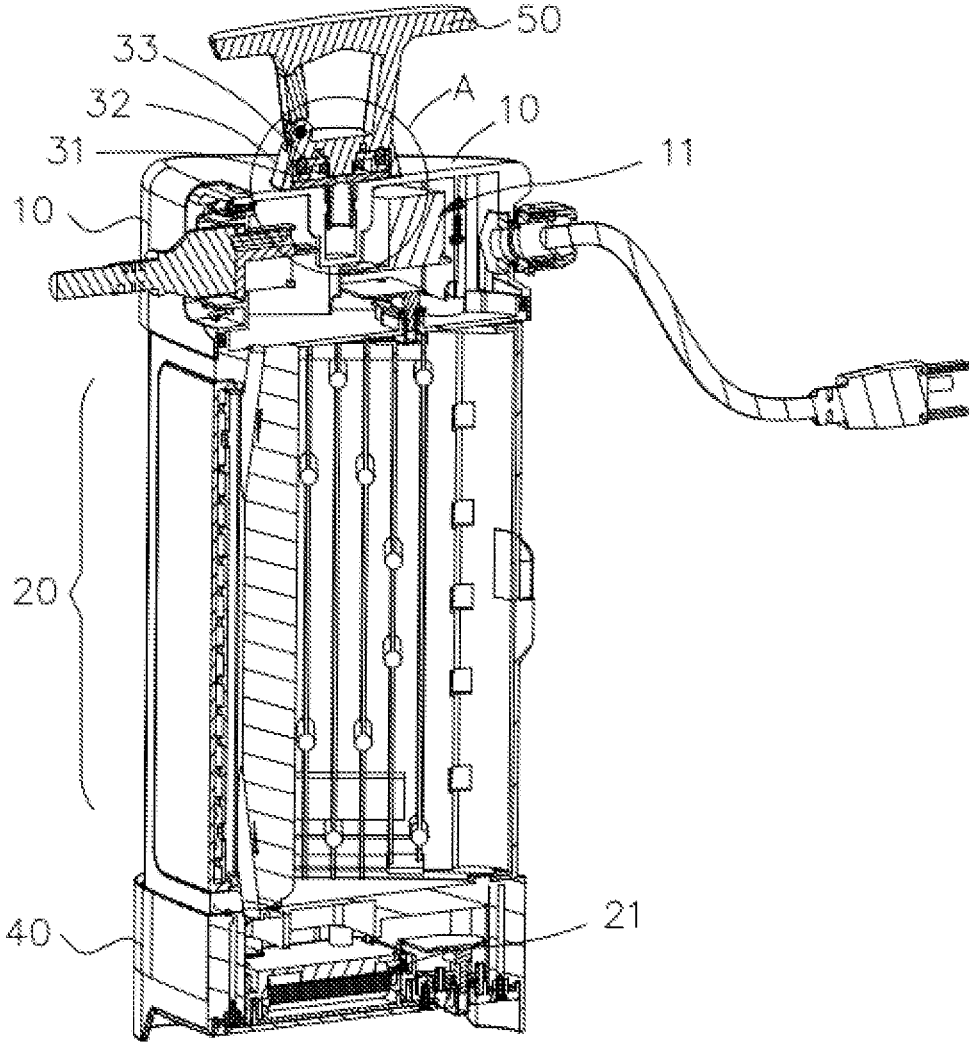
FIG. 2 is a cross sectional view of the lighting lamp of FIG. 1.
Figure 3:
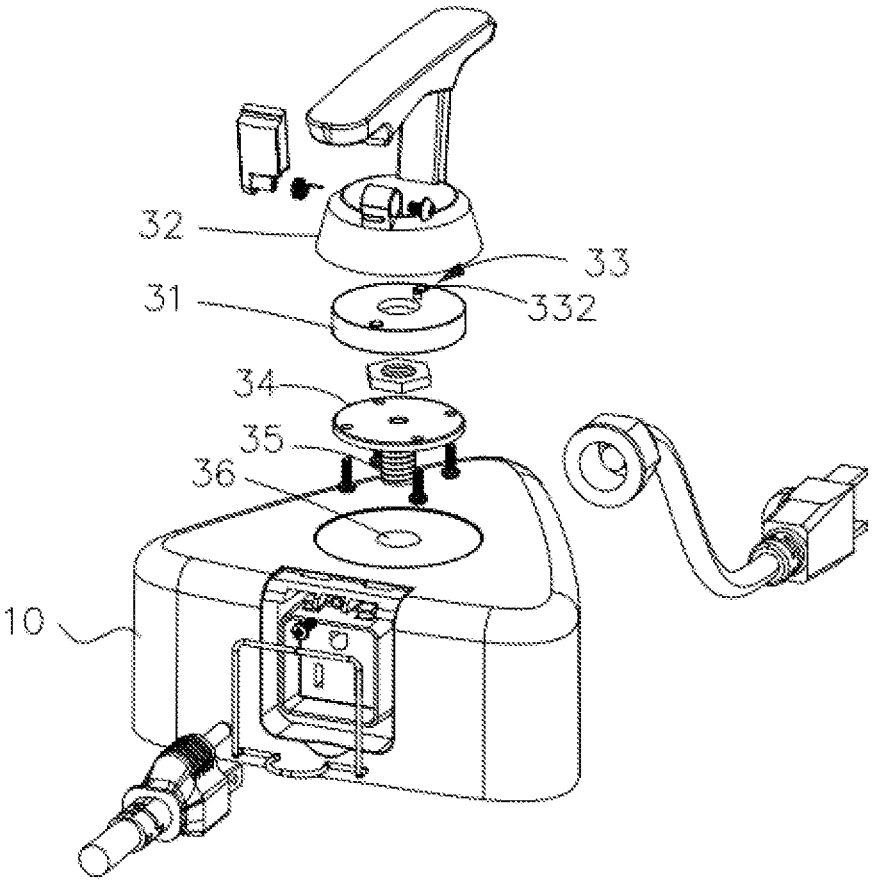
FIG. 3 is an exploded, schematic view of the lighting lamp of FIG. 1.
Figure 4:
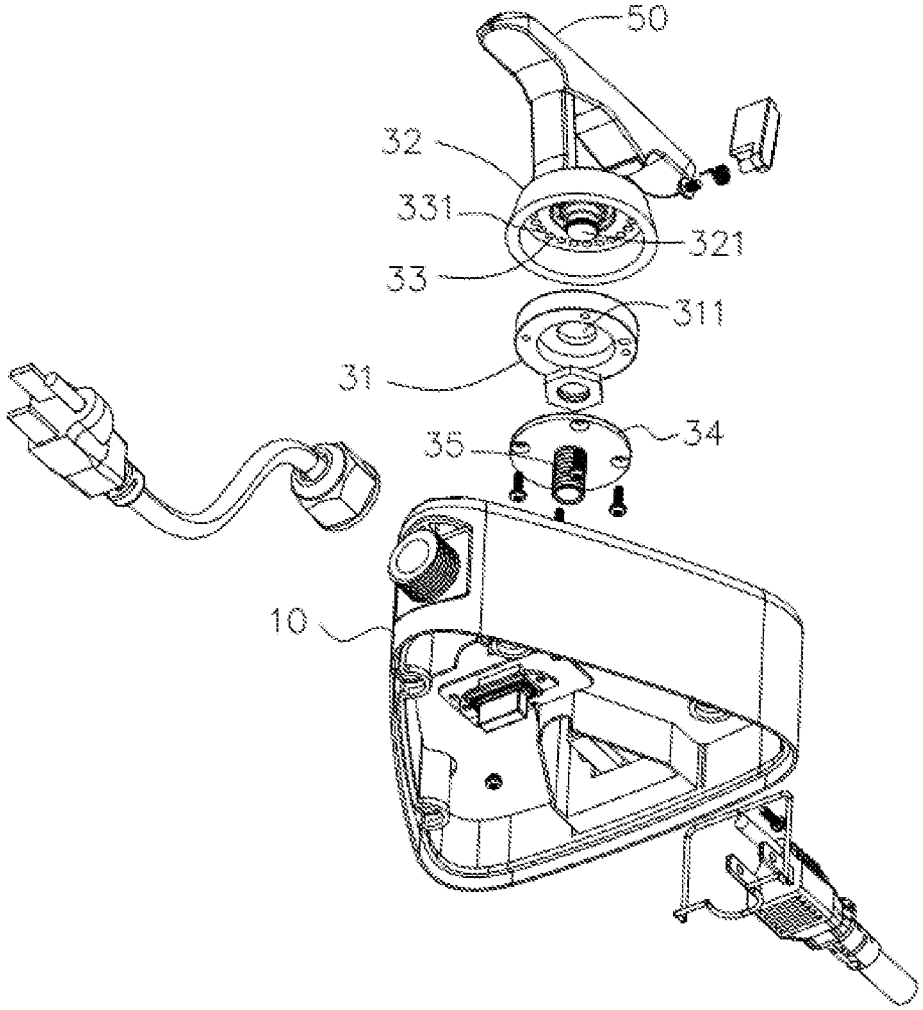
FIG. 4 is similar to FIG. 3, but shown from another view.

Referring to FIG. 2 to FIG. 4, furthermore, the rotating portion 30 includes a fixing disc 31 fixed on the upper body 10, and an upper cover 32 installed on the upper body 10 and configured to receive the fixing disc 31 therein. The fixing disc 31 is rotationally connected with the upper cover 32 to adjust the irradiation angle of the lighting unit 20.

In an embodiment of the present disclosure, the fixing disc 31 and the lighting unit 20 are connected and move synchronously with each other; the upper cover 32 is sleeved on the fixing disc 31, so that the upper cover 32 is arranged on the upper body 10, and the hanging ring 50 is fixed on the upper cover 32. When rotation adjustment is required, the fixing disc 31 rotates relative to the upper cover 32, and the hanging ring 50 that connects to the upper cover 32 also rotates with the upper cover 32, so that the lighting unit 20 rotates relative to the hanging ring 50 to adjust the irradiation angle and a lighting range of the lighting unit 20.

Referring to FIG. 3 and FIG. 4, furthermore, the fixing disc 31 and the upper cover 32 are provided with a third limiting member 33 configured to limit a continuous rotation of the hanging ring 50 when the lighting unit 20 rotates relative to the hanging ring 50.

The third limiting member 33 includes a plurality of receiving holes 331 arranged on a side surface of the upper cover 32 that faces the fixing disc 31 in a circumferential array, and at least one second pinball 332 installed on a side surface of the fixing disc 31 that faces the upper cover 32.

When the lighting unit 20 rotates, the at least one second pinball 332 rotates synchronously with the fixing disc 31 relative to the upper cover 32, and the at least one second pinball 332 contacts with at least one of the plurality of receiving holes 331 that is arranged in the circular array, with a rotation angle thereof, and then is pressed into the at least one of the plurality of receiving holes 331, to limit positions of the lighting unit 20.

In an embodiment of the present disclosure, there can be a plurality of second pinballs 332 which can ensure reliability of locking and limiting the lighting unit 20.

After the second pinball 332 is pressed into the receiving hole 331, the lighting unit 20 can be adjusted again only when the lighting unit 20 is rotated by applying an external force again, when no external force is applied, the second pinball 332 locks the upper cover 32 and the fixing disc 31, that is, the hanging ring 50 and the lighting unit 20 are fixed with each other.

Figure 5:
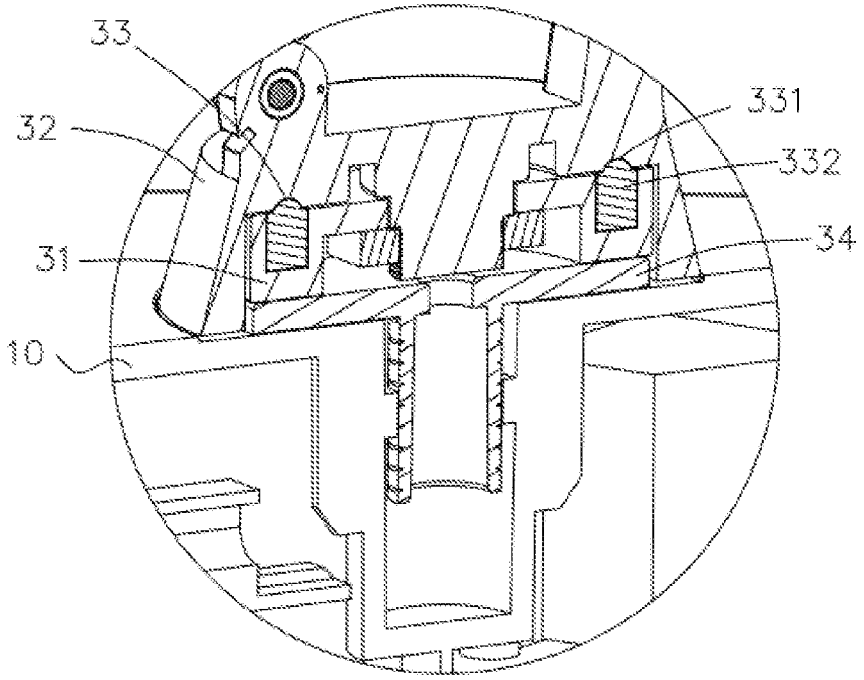
FIG. 5 is a partial enlarged view of circle A of FIG. 2.

Referring to FIG. 3 to FIG. 5, in an embodiment of the present disclosure, furthermore, the rotating portion 30 further includes a fixing member 34 fixed with the fixing disc 31, the fixing disc 31 including a through-hole 311 arranged a center thereof, the upper cover 32 including a fixing post 321 passing through the through-hole 311 to rotationally fix with the fixing disc 31, and the fixing disc 31 rotating with the fixing post 321 as the center thereof. When the lighting unit 20 rotates, all the upper body 10, the fixing member 34 and the fixing disc 31 rotate synchronously, while the upper cover 32 and the hanging ring 50 are relatively stationary, so as to implement a purpose of rotation adjustment thereof.

A threaded post 35 is arranged on a side of the fixing member 34 that faces the upper body 10, a threaded hole 36 is arranged on the upper body 10 and corresponding to the threaded post 35, and the threaded post 35 is connected with the threaded hole 36.

In an embodiment of the present disclosure, the rotating portion 30, including the fixing member 34, the fixing disc 31 and the upper cover 32, that is connected to the side of the threaded post 35 is fixed on the side of the upper body 10 close to the threaded hole 36 by a thread connection way. When the rotating portion 30 needs to be removed from the upper body 10, only the threaded post 35 needs to be taken out of the threaded hole 36, which is more convenient for installation and removal.

Referring to FIG. 2, in an embodiment of the present disclosure, the lighting lamp further includes a lower body 40, the upper body 10 configured to receive a driving module 11 therein, the lower body 40 configured to receive an emergency power supply module 21 therein, and the driving module 11 and the emergency power supply module 21 are electrically connected with each other.

The lighting lamp of the present disclosure has a variety of lighting modes, one of the lighting modes that is to supply power through an external power supply of the driving module 11, to light the lighting unit 20 by the external power supply; when the external power supply is connected, the driving module 11 simultaneously transmits electric energy of the external power supply to the emergency power supply module 21 for storage. The other of the lighting modes is that when there is no external power supply, the internal emergency power supply module 21 is configured to supply power for the lighting unit 20, to light up the lighting unit 20.

Through freely selecting the above two modes, not only it can light the lighting unit 20 by using the external power supply for lighting indoors, but also it can be portable to the outdoors to light the lighting unit 20 by using the emergency power supply.

Figure 6:
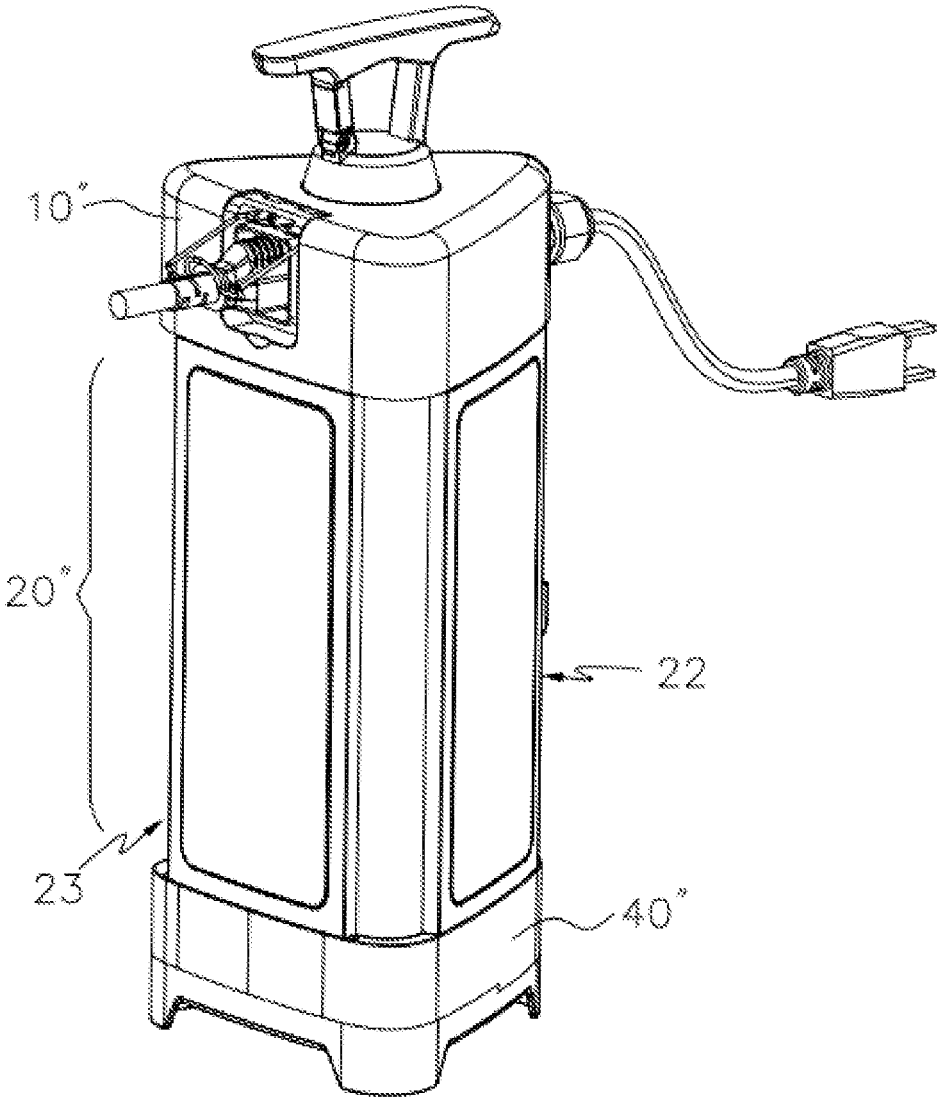
FIG. 6 is a schematic view of a lighting lamp in accordance with another embodiment of the present disclosure, shown the lighting lamp in a closed state.
Figure 7:
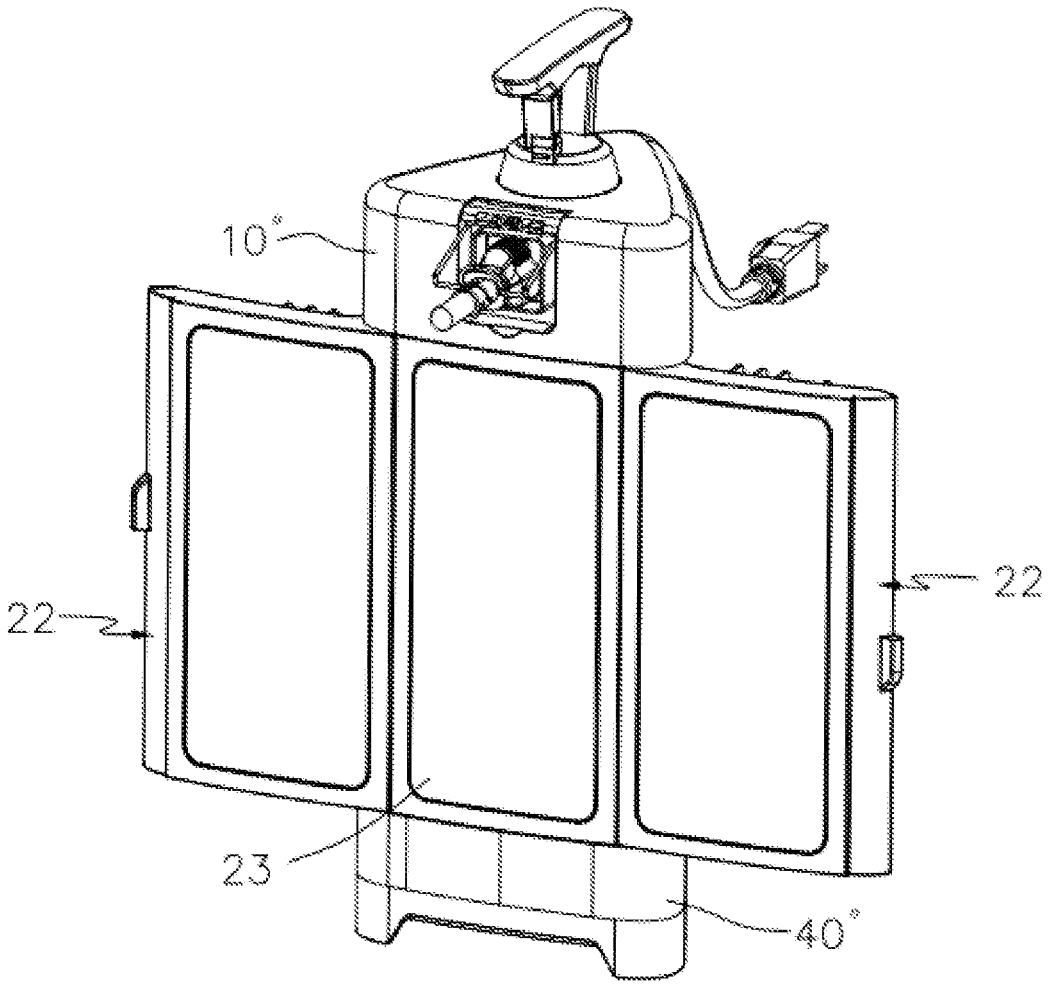
FIG. 7 is similar to FIG. 6, but shown the lighting lamp in an open state.

Referring to FIG. 6 and FIG. 7, a lighting lamp according to another embodiment of the present disclosure is provided. The lighting lamp includes an upper body 10", a lower body 40" arranged opposite to the upper body 10", and a lighting unit 20" configured to light the lighting lamp and including at least one first lighting module 22 rotationally connected between the upper body 10" and the lower body 40". The at least one first lighting module 22 is configured to adjust an irradiation angle when the at least one first lighting module 22 rotates.

In another embodiment of the present disclosure, the lighting lamp further includes a second lighting module 23 connected between the upper body 10" and the lower body 40" and configured to light the lighting lamp.

A cross section of each of the upper body 10" and the lower body 40" towards the first lighting module 22 is triangular, there are two first lighting modules 22 in the embodiment of the present disclosure, and the two first lighting modules 22 are separated on both sides of the second lighting module 23, respectively.

In other embodiments of the present disclosure, cross sections of the upper body 10" and the lower body 40" towards the first lighting module 22 can be other polygonal shapes. At this time, the second lighting module 23 is fixed between the upper body 10" and the lower body 40"; a plurality of first lighting modules 22 can be rotationally connected in turn, and it can open and close the plurality of first lighting modules 22 by dragging the first lighting module 22 far away from the farthest end of the second lighting module 23.

In an embodiment of the present disclosure, the two first lighting modules 22 can rotate on and off on both sides of the second lighting module 23, respectively, so as to light the lighting lamp with a multi-angle and a multi-range, and also show a variety of irradiation states at the same time, specifically:

the two first lighting modules 22 are in an open state when the two first lighting modules 22 rotate from an outside of the lighting lamp to a maximum position thereof, and when the two first lighting modules 22 are in the open state, both the two first lighting modules 22 and the second lighting module 23 are in the same plane to implement plane lighting.

The two first lighting modules 22 are in a closed state when the two first lighting modules 22 rotate from the outside of the lighting lamp to an inside of the lighting lamp to the maximum position thereof; and when the two first lighting modules 22 are in the closed state, both the two first lighting modules 22 and the second lighting module 23 jointly form a triangular column therebetween to implement multi-faceted lighting.

When the two first lighting modules 22 are in a state between the open state and the closed state, the lighting lamp is in an adjustable state that the irradiation angle can be adjusted so as to freely adjust the irradiation angle and the lighting range of the lighting lamp between the open state and the closed state.

That is to say, the two first lighting modules 22 is to respectively take their respective sides close to the second lighting module 23 as their respective rotation centers, and is to take their respective opposite sides of the two first lighting modules 22 away from the second lighting module 23 as their corresponding farthest ends to rotate for sweeping a fan-shaped area. According to requirements of the irradiation angle and the irradiation range, a size of the fan-shaped area that has been swept can be adjusted freely. When the fan-shaped area that has been swept is the minimum, the lighting lamp is in the closed state, at this time, the lighting lamp is in a multi-faceted lighting mode, and the lighting range is 360° around the periphery of the lighting lamp; while, when the size of the fan-shaped area that has been swept is the maximum, the lighting lamp is in the open state, at this time, the lighting lamp is in a plane lighting mode, and the lighting range is 180° of the lighting lamp towards the side of the second lighting module 23; when the size of the fan-shaped area that has been swept is between the maximum and the minimum, the larger the fan-shaped area that has been swept, the smaller the irradiation range of the lighting lamp.

Figure 8:
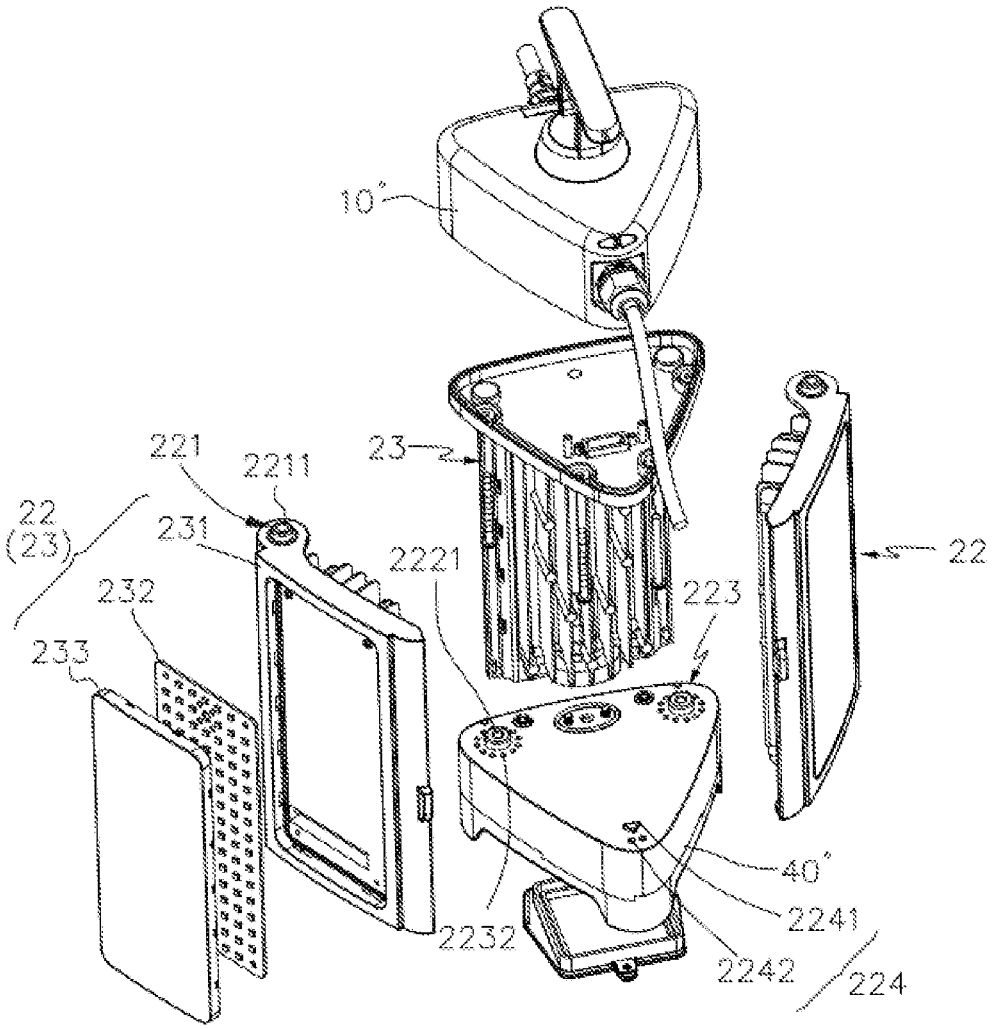
FIG. 8 is an exploded, schematic view of the lighting lamp of FIG. 6.
Figure 9:
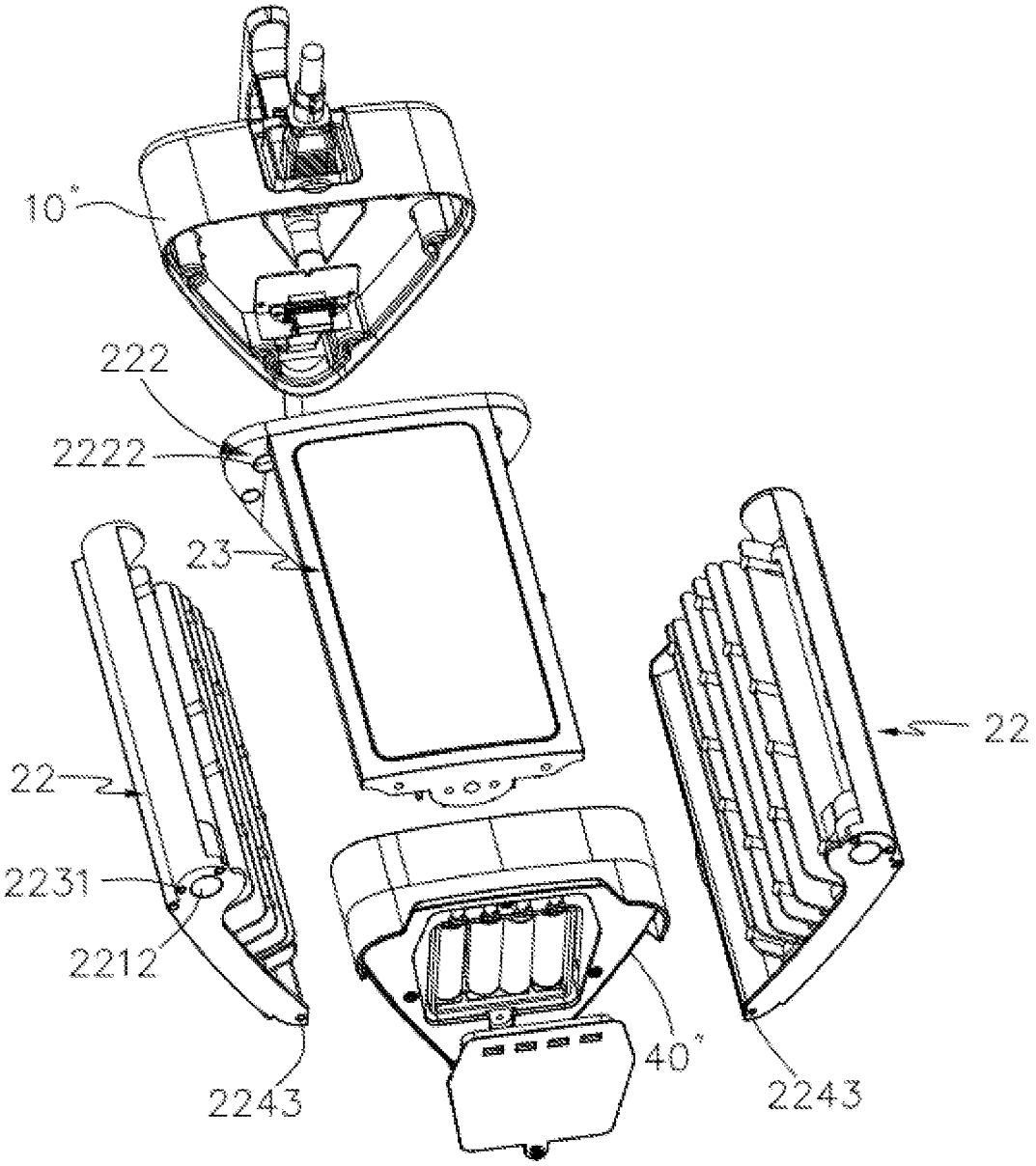
FIG. 9 is similar to FIG. 8, but shown from another view.

Referring to FIG. 8 and FIG. 9, in an embodiment of the present disclosure, the first lighting module 22 includes a first rotating member 221, each of the upper body 10" and the lower body 40" including a first connecting member 222 rotationally connected to the first rotating member 221, so that the first lighting module 22 is rotationally connected between the upper body 10" and the lower body 40".

The first rotating member 221 is arranged at an end of the first lighting module 22 close to the second lighting module 23, the first rotating members 221 of the two first lighting modules 22 arranged on both sides of the second lighting module 23, respectively; and the first connecting member 222 and the first rotating member 221 are arranged opposite to each other.

The first rotating member 221 includes a first rotating shaft 2211 and a first shaft hole 2212, the first rotating shaft 2211 arranged at the end of the first lighting module 22 close to the upper body 10"; the first shaft hole 2212 arranged at the end of the first lighting module 22 close to the lower body 40"; both the first rotating shaft 2211 and the first shaft hole 2212 arranged on one side close to the second lighting module 23 and opposite to each other.

The first connecting member 222 includes a second rotating shaft 2221 and a second shaft hole 2222. The second rotating shaft 2221 is arranged on the lower body 40" and opposite to the first shaft hole 2212; the second shaft hole 2222 arranged on the upper body 10" and opposite to the first rotating shaft 2211.

In an embodiment of the present disclosure, the first rotating shaft 2211 is received in the second shaft hole 2222, and the second rotating shaft 2221 is received in the first shaft hole 2212. When the first lighting module 22 rotates, the first rotating shaft 2211 rotates in the second shaft hole 2222, and the first shaft hole 2212 rotates relative to the second rotating shaft 2221 at the same rotation angle as the second shaft hole 2222, so as to implement a fan-shaped folding of the lighting unit 20".

The first lighting module 22 and the lower body 40" provide with a first limiting member 223 arranged at a position where the first rotating member 221 is, and configured to limit the position of the first lighting module 22 when the first lighting module 22 rotates, so as to implement multi-angle adjustment of the first lighting module 22.

Specifically, the first limiting member 223 includes at least one first pinball 2231 and a plurality of limiting holes 2232. The at least one first pinball 2231 is installed on an end face of the first limiting member 223 that faces the lower body 40", and arranged on a side of the first rotating shaft 2211; the plurality of limiting holes 2232 is arranged outside the second rotating shaft 2221 in a circular array.

When the first lighting module 22 rotates, the at least one first pinball 2231 contacts with at least one of the plurality of limiting holes 2232 that is arranged in the circular array, with a rotation angle thereof, and then is pressed into the at least one of the plurality of limiting holes 2232, to limit positions of the two first lighting modules 22.

More specifically, when the first lighting module 22 rotates to an angle, the first pinball 2231 is located in the limiting hole 2232 and fixed by the limiting hole 2232. When the first lighting module 22 continuously rotates by an external force, the first pinball 2231 moves from one of the limiting holes 2232 to another of the limiting holes 2232 in turn along the circular array until the external force disappears and the first pinball 223 stops moving. At this time, a first stop is located in another of the limiting holes 2232, so as to obtain the purpose of limiting fixation of the first lighting module 22.

The lower body 40" includes a second limiting member 224 arranged opposite to the second lighting module 23; the two first limiting members 223 and the second limiting member 224 arranged in a triangle with each other, and respectively located near three vertices of the lower body 40" with a triangular cross section thereof, and the second limiting member 224 configured to limit the maximum position where the two first lighting modules 22 are closed at the same time.

The second limiting member 224 includes a limiting block 2241 and a protrusion 2242. The limiting block 2241 is located on the lower body 40" and configured to prevent the first lighting module 22 from continuing to rotate towards the inside of the lighting lamp when the first lighting module 22 is in the closed state. The protrusion 2242 is arranged near the limiting block 2241 and located between the limiting block 2241 and a vertex of the lower body 40" closest to the limiting block 2241.

A concave hole 2243 is arranged on an end face of the first lighting module 22 close to the lower body 40", and located on the side of the first lighting module 22 away from the second shaft hole 2222. The concave hole 2243 and the protrusion 2242 correspond to each other, when the first lighting module 22 is in the closed state, the protrusion 2242 is located in the concave hole 2243 for fixing the first lighting module 22.

There are two protrusions 2242 in the present disclosure, and when the two first lighting modules 22 are in the closed state, the two concave holes 2243 of the two first lighting modules 22 correspond to one of the two protrusions 2242, respectively.

Furthermore, each of the first lighting module 22 and the second lighting module 23 includes a frame 231, a lighting plate 232 and a lampshade 233. The lighting plate 232 is received in the frame 231, and the lampshade 233 covers on the lighting plate 232 to form a closed structure together with the frame 231. The lighting plate 232 is an LED board that includes a plurality of LED beads formed thereon and electrically connected with the driving module 11 and/or the emergency power supply module 21.

In the present disclosure, the frame 231 of the second lighting module 23 is fixed between the upper body 10" and the lower body 40".

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. A lighting lamp comprising:

an upper body;

a lower body arranged opposite to the upper body; and a lighting unit configured to light the lighting lamp and comprising at least one first lighting module rotationally connected between the upper body and the lower body; and wherein the at least one first lighting module is configured to adjust an irradiation angle when the at least one first lighting module rotates; and wherein the lighting lamp further comprises a second lighting module connected between the upper body and the lower body and configured to light the lighting lamp, the at least one first lighting module comprising two first lighting modules; and wherein the two first lighting modules are in an open state when the two first lighting modules rotate from an outside of the lighting lamp to a maximum position thereof, and the two first lighting modules are in a closed state when the two first lighting modules rotate from the outside of the lighting lamp to an inside of the lighting lamp to the maximum position thereof;

when the two first lighting modules are in the open state, both the two first lighting modules and the second lighting module are in the same plane to implement plane lighting; and when the two first lighting modules are in the closed state, both the two first lighting modules and the second lighting module jointly form a triangular column therebetween to implement multi-faceted lighting; and wherein when the two first lighting modules are in a state between the open state and the closed state, the lighting lamp is in an adjustable state that the irradiation angle can be adjusted so as to freely adjust the irradiation angle and a lighting range of the lighting lamp; and wherein each of the first lighting modules comprises a first rotating member, each of the upper body and the lower body comprising a first connecting member rotationally connected to each of the first lighting modules, so that each of the first lighting modules is rotationally connected between the upper body and the lower body; and wherein the first rotating member is arranged at an end of the first lighting module close to the second lighting module, the first rotating members of the two first lighting modules arranged on both sides of the second lighting module, respectively; and the first connecting member and the first rotating member are arranged opposite to each other; and wherein the first rotating member comprises:

a first rotating shaft arranged at the end of the first lighting module close to the upper body;

a first shaft hole arranged at the end of the first lighting module close to the lower body;

both the first rotating shaft and the first shaft hole arranged on one side close to the second lighting module and opposite to each other;

the first connecting member comprising:

a second rotating shaft arranged on the lower body and opposite to the first shaft hole;

a second shaft hole arranged on the upper body and opposite to the first rotating shaft; and wherein the first rotating shaft is received in the second shaft hole, and the second rotating shaft is received in the first shaft hole; and wherein each of the first lighting modules and the lower body provide with a first limiting member arranged at a position where the first rotating member is, and configured to limit the position of each of the first lighting modules when each of the first lighting modules rotates, so as to implement multi-angle adjustment of each of the first lighting modules; and wherein the first limiting member comprises:

at least one first pinball installed on an end face of the first limiting member that faces the lower body, and arranged on a side of the first rotating shaft;

a plurality of limiting holes arranged outside the second rotating shaft in a circular array; and wherein when the first lighting module rotates, the at least one first pinball contacts with at least one of the plurality of limiting holes that is arranged in the circular array, with a rotation angle thereof, and then is pressed into the at least one of the plurality of limiting holes, to limit positions of the two first lighting modules.

2. The lighting lamp as claimed in claim 1, wherein a cross section of each of the upper body and the lower body towards the two first lighting modules is triangular, and the two first lighting modules are separated on both sides of the second lighting module.

3. The lighting lamp as claimed in claim 1, wherein the lower body comprises a second limiting member arranged opposite to the second lighting module; the two first limiting members and the second limiting member arranged in a triangle with each other, and respectively located near three vertices of the lower body with a triangular cross section thereof, and the second limiting member configured to limit the maximum position where the two first lighting modules are closed at the same time.

4. The lighting lamp as claimed in claim 3, wherein the second limiting member comprises:

a limiting block located on the lower body and configured to prevent the first lighting module from continuing to rotate towards the inside of the lighting lamp when the first lighting module is in the closed state;

a protrusion arranged near the limiting block and located between the limiting block and a vertex of the lower body closest to the limiting block;

a concave hole arranged on an end face of the first lighting module close to the lower body, and located on the side of the first lighting module away from the second shaft hole; and wherein the concave hole and the protrusion correspond to each other, when the first lighting module is in the closed state, the protrusion is located in the concave hole for fixing the first lighting module.

5. The lighting lamp as claimed in claim 4, wherein there are two protrusions, and when the two first lighting modules are in the closed state, the two concave holes of the two first lighting modules correspond to the two protrusions one by one, respectively.

6. The lighting lamp as claimed in claim 1, wherein each of the first and second lighting modules comprises:

a frame;

a lighting plate received in the frame; and a lampshade covered on the lighting plate.

7. The lighting lamp as claimed in claim 6, wherein the frame of the second lighting module is fixed between the upper body and the lower body.

* * * * *